United States Patent [19]

Hardwick et al.

[11] 4,326,544

[45] Apr. 27, 1982

[54] SMOKING PRODUCT

[75] Inventors: Michael J. Hardwick, Geneva, Switzerland; Kenneth R. McMeekan, Whitehead, Northern Ireland

[73] Assignee: Gallaher Limited, Belfast, Northern Ireland

[21] Appl. No.: 199,721

[22] PCT Filed: Dec. 11, 1979

[86] PCT No.: PCT/GB79/00210

§ 371 Date: May 8, 1980

§ 102(e) Date: May 8, 1980

[87] PCT Pub. No.: WO80/01132

PCT Pub. Date: Jun. 12, 1980

[30] Foreign Application Priority Data

Dec. 11, 1978 [GB] United Kingdom ..... 47896/78

[51] Int. Cl.[3] ..... A24D 1/18

[52] U.S. Cl. ..... 131/369; 131/359

[58] Field of Search ..... 131/369

[56] References Cited

U.S. PATENT DOCUMENTS 4,044,777 8/1977 Boyd et al. ..... 131/369

*Primary Examiner*—V. Millin

*Attorney, Agent, or Firm*—Murray and Whisenhunt

[57] ABSTRACT

Cigarettes are formed by subjecting a three dimensional needled felt web of viscose fibres to a controlled pyrolysis, loading the felt web with smoking and combustion agents, cutting the felt web into strips and wrapping individual strips in a tubular wrapper.

11 Claims, 1 Drawing Figure

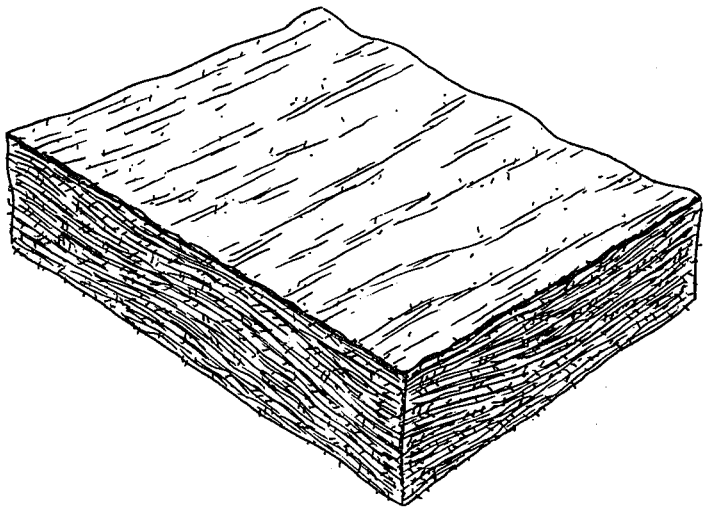

SMOKING PRODUCT

The invention relates to the production of a fuel for use in a tobacco substitute.

One previous approach has involved the pyrolysis of cellulosic material to form a basic fuel to which smoking ingredients are added. For example, various proposals have been disclosed in British Patent Specifications Nos. 1,113,979 and 1,481,056 and in U.S. Pat. Nos. 3,545,448, 3,861,401, 3,861,402, and 4,019,521. However, in our view these proposals result in insufficient degradation of the cellulose to carbon for any significant decrease in the potentially harmful organic components in the smoke when the product is burnt, compared with natural tobacco. Furthermore, the thermally degraded product is combined with various binders which themselves may contribute undesirably to the organic vapour phase of the smoke. There is also insufficient appreciation of the importance of the physical parameters of the cellulose filaments which are thermally degraded so that the physical acceptability of the product is poor for use as a cigarette filler, both in terms of handling the product and the pressure drop and hardness of cigarettes filled with the product.

Another proposal is to be found in U.S. Pat. No. 3,738,374, in which a tobacco substitute is made from carbon or graphite fibres. However commercially available graphite fibres are useless for simple combustion in air and an oxidising agent has to be incorporated, this inevitably introducing other elements and unknown health hazards.

In our British Patent Specification No. 1,431,045 we disclose a tobacco substitute consisting essentially of a carbonaceous fuel which, disregarding any inert fillers, consists of at least 80%, and preferably over 90%, carbon by weight, and includes no elements other than carbon, hydrogen and oxygen. The fuel is prepared by the controlled pyrolysis of a cellulosic material such as viscose. The raw material from which the fuel is produced, and hence the fuel, preferably consists of a coherent mass of fibres which has, after the pyrolysis, a cross sectional dimension of between 1 and 50 $\mu$. Upon pyrolysis the cellulosic material is degraded with the result that when the fuel is burnt, the combustion products are essentially carbon dioxide and water which involve no health risks when inhaled. When used as a tobacco substitute, the fuel is associated as necessary with agents, particularly volatile ingredients such as organoleptic and physiologically active agents, and combustion modifying (which term includes ash producing) agents.

Our subsequent experiments have shown that viscose is an exceptionally good starting material owing to the possibility of obtaining large quantities of viscose in fibrous form with selected and uniform dimensions and composition which are virtually impossible with any naturally occuring cellulosic fibrous material. The use of viscose therefore enables a smoking product to be mass produced with exactly the properties which experiments show to be most desirable. Apart from its reliable reproducability, fibrous viscose has the advantage that it has a high bending modulus, both before and after pyrolysis, which simplifies handling of the product.

Our DOS No. 27 44 728 discloses a method of making a smoking product wherein viscose in strand form is subjected to controlled pyrolysis until the organic residue contains at least 90% carbon by weight, and the resulting strand is loaded with the ingredients for smoking. As described in the DOS, the strand is preferably a sliver of staple fibres. In practice the sliver is prepared by laying a fleece of a large number of the fibres alongside one another and drawing them through a bundling garniture to produce the sliver. The drawing action tends to cause some of the fibres to slip longitudinally relatively to others so that the resulting sliver does not have an absolutely uniform cross section and, owing to the fact that the fibres in the sliver tend to be parallel to one another, the sliver has little mechanical shape sustaining strength and is readily compressed or divided. It can only sustain low tension and this was recognised in the DOS where it was indicated that it might be necessary positively to convey the sliver through the pyrolysis oven. It was suggested in the DOS that a number of the strands could be laid beside one another to form a mat during passage through the pyrolysis oven to increase the oven throughput but this did not involve any integration of the sliver.

In accordance with the present invention, in a method of making a fuel for a tobacco subsitute, viscose fibres are prepared in the form of a felt web in which the fibres have a three dimensional lay, and the felt web is subjected to controlled pyrolysis until the organic residue contains at least 90% carbon by weight. The resulting felt web, after loading with combustion modifying agents and volatile ingredients for smoking, is divided into pieces for smoking.

The processing of the viscose fibres in the form of a felt web has been shown to lead to a number of advantages. The fibres are particularly cohesive in the felt and thus material handling problems associated with transporting a number of slivers through the pyrolysis stage as proposed in out DOS No. 27 44 728 are reduced. The three dimensional lay of the fibre gives good resilient resistance to being compressed so that when used as a filler for a cigarette or other smoking rod, it provides a good filling capacity with an acceptable hardness and pressure drop. In fact a significant reduction in carbon weight per standard cigarette can be achieved, of approximately 20%. Ashing characteristics are also improved. The uniformity of the density of the felt can be accurately maintained so that the addition of materials such as smoke producing agents, nicotine salts, combustion modifying agents and flavouring agents, can be reproductively performed. The web also provides a convenient form for application of the various additives during pre- and post-pyrolysis treatment.

The felt web may be produced by any of the methods which are conventional in felt making fields to provide a three dimensional lay, for example by continually laying a fleece of low areal density fibres, produced from carded fibres, to and fro, parallel to the direction in which the fibres extend, on top of itself to produce a multi-layer fleece, which is slowly withdrawn perpendicularly to the direction of laying. A typical multi-layer fleece may include 50 layers and be about 2 m. wide. The multi-layer fleece is then nedled in conventional fashion by inserting and withdrawing barbed needles, which reduces its thickness. Alternatively the felt web could be an air laid fleece suitable needled.

The felt web can be of any appropriate length and may be stored prior to being passed through the pyrolysis oven, although it would be possible to provide the pyrolysis oven in line with the felt forming machinery.

In the production of cigarettes or other smoking rods, the porous felt web, with all the additives for smoking, is preferably slit longitudinally and the individual strips formed into cylindrical shape and wrapped in a tubular wrapper.

For this purpose, the felt web of viscose fibres, after needling and prior to pyrolysis, may have a bulk density of between 5 and 80, preferably between 25 and 40, kg./cu.m. and an areal density of between 0.15 and 1.0, preferably between 0.2 and 0.6, kg./sq.m. These bulk and areal densities mean that the web will have a thickness of between 0.3 and 10, and preferably between 0.3 and 5, cms.

During the subsequent pyrolysis, the thickness of the web will shrink by about 30%. The web may then be cut into strips of between 0.3 and 10, preferably between 0.3 and 5, cm. wide to provide, upon compression in a surrounding tubular wrapper, the full cross-section of the porous filler of a cigarette or similar smoking rod.

The form of the individual viscose fibres and the treatment steps before and after the pyrolysis may be the same as those described in out DOS. No. 27 44 728. Thus the fibres are preferably staple fibres having a length of between 20 and 100 mm. and the denier of the fibres is preferably between 5 and 20. The fibres may be crimped to improve their filling capacity and between 3 and 5 complete wave of crimps per cm. are preferred. When the fibres are crimped they are preferably of substantially round cross section.

The pyrolysis of the felt in the oven is carried out under an inert atmosphere and the pyrolysis may involve a sequence of heating steps in which the viscose is first heated to between 200° C. and 300° C. to dry the viscose, then heated from between 200° C. and 300° C. to between 400° C. and 550° C. during which the major chemical transformation reactions of the viscose take place whereafter the temperature of the viscose is quickly raised to between 700° C. and 1200° C., preferably between 700° C. and 900° C., where the transformation of the viscose to carbon is completed. During the pyrolysis up to 80% or more by weight of the viscose content of the fibre will be driven off and there will be a linear shrinkage of about 30%. It is believed that the carbon content of the organic residue of the viscose is ideally between 95% and 98% by weight, the oxygen content between 1 and 4% by weight and a hydrogen content less than 1% by weight.

As described in our DOS, it is desirable to add to the viscose fibres, prior to pyrolysis, any of the fillers or additives which are necessary in the conversion of the viscose into a tobacco substitute, and which will not be lost or unacceptable degraded during the pyrolysis. Such fillers or additives, or their precursors, may include carriers for the volatile agents to be added subsequently, catalysts for the pyrolysis, and combustion modifying agents. Some of these may be introduced as fillers into the bulk viscose mix prior to spinning in which case they will be homogeneously dispersed throughout the viscose fibres. Others, particularly those which would be undesirably effected by the spinning bath or the subsequent washing steps, particularly in acid, may be homogeneously dispersed in the viscose felt, for example by spraying onto staple fibres from which the felt is made, by application to the felt with a binder, or by passing the felt through a dip.

Subsequent to the pyrolysis, further additives may be applied to the pyrolysed felt, particularly by spraying on or by passing the felt through a dip. Such subsequently applied additives may include combustion modifying agents, nicotine, smoke producing agents, and flavouring agents.

EXAMPLE

In one example staple denier supercrimp matt finish viscose fibres were pretreated with calcium formate solution to provide a deposit in the fibres amounting to 0.8% of calcium by weight of the viscose. The fibres were then made into a felt web by a needling technique, the felt web having a bulk density of 60 kg./cu.m., an areal density of 0.6 kg./sq.m. and a thickness of 1 cm.

The web was pyrolysed in an oven under an atmosphere of nitrogen up to a temperature of 780° C. at which temperature it was retained for thirty minutes.

After leaving the oven the pyrolysed web was post-treated with a solution of three phosphates salts containing 0.7 M tripotassium phosphate, 0.8 M trisodium phosphate, and 1.5 M potassium dihydrogen phosphate. The phosphates salts were retained within the web with a retention factor of 3.6.

The treated web was then slit into strips each 3 cm. wide and the strips were compressed through a garniture and wrapped in a tubular paper wrapper to produce a cigarette rod which was cut into 59 mm. long cigarettes. Each cigarette contained 200 mg. of carbon and 450 mg. of phosphate. Each cigarette had a hardness of 85%, a puff number of nine, a cone length of 4 mm., and the ash was white, coherent and tobacco like.

The accompanying drawing illustrates diagrammatically the felt web prior to or after pyrolysis.

We claim:

1. A method of making a tobacco substitute fuel smoking rod, said method comprising preparing viscose fibers in the form of a felt web in which the fibers have a three dimensional lay, a bulk density of between 5 and 80 kg/cu. m., and an areal density of between 0.15 and 1.0 kg/sq. m., subjecting said felt web to controlled pyrolysis until the organic residue contains at least 90% carbon by weight, loading the felt web with combustion modifying agents and volatile ingredients for smoking, dividing the felt web into strip pieces for smoking, and wrapping individual strip pieces in a tubular wrapper to form said smoking rods.

2. A method according to claim 1, in which the three dimensional lay is produced by needling.

3. A method according to claim 1 or claim 2, in which the fibres are staple fibres having a length of between 20 and 100 mm.

4. A method according to claim 1, in which the fibres have a denier of between 5 and 20.

5. A method according to claim 1, in which the fibres are crimped.

6. A method according to claim 1, in which the bulk density is between 25 and 40 kg./cu.m.

7. A method according to claim 1, in which the areal density is between 0.2 and 0.6 kg./sq.m.

8. A method according to any one of the preceding claims, in which the felt web is loaded with combustion modifying agents and volatile ingredients for smoking and divided into pieces for smoking.

9. A product which has been made by a method according to claim 1.

10. Method of claim 1, wherein the felt web is cut into strips of between 0.3 and 10 cm. in width.

11. Method of claim 10, wherein the strips are between 0.3 and 5 cm. in width.

* * * * *